United States Patent [19]

Bomgardner

[11] Patent Number: 4,741,085

[45] Date of Patent: May 3, 1988

[54] REPAIR OF RAILWAY CUSHIONING APPARATUS

[75] Inventor: Charles T. Bomgardner, Burleson, Tex.

[73] Assignee: Halliburton Company, Duncan, Okla.

[21] Appl. No.: 912,888

[22] Filed: Sep. 25, 1986

[51] Int. Cl.[4] ..... B23P 6/00

[52] U.S. Cl. ..... 29/402.08; 29/402.01; 29/402.03

[58] Field of Search ..... 29/402.01, 402.03, 402.08; 213/8, 43, 223

[56] References Cited

U.S. PATENT DOCUMENTS

| | | | |
|---|---|---|---|
| 1,036,340 | 8/1912 | Rockwell et al. . | |
| 2,039,268 | 4/1936 | Barrows . | |
| 2,944,639 | 7/1960 | Blake . | |
| 3,178,037 | 4/1925 | Kendall | 213/40 R |
| 3,491,993 | 1/1970 | Scholin et al. | 261/1 |
| 3,554,387 | 1/1971 | Thornhill | 213/223 |
| 3,556,311 | 1/1971 | Kinnecom . | |
| 3,589,527 | 6/1971 | Seay et al. | 213/8 |
| 3,651,953 | 3/1972 | Knippel et al. . | |
| 3,931,775 | 8/1974 | Hawthorne . | |
| 4,026,418 | 5/1977 | Hawthorne | 213/8 |
| 4,113,113 | 9/1978 | Reinhardt et al. | 213/43 |
| 4,175,667 | 11/1979 | Dillner et al. . | |

OTHER PUBLICATIONS

Exhibit A—Brochure dated May 1, 1984, of Driv-Lok, Inc., of Sycamore, Ill.

Exhibit B—Brochure of Groov-Pin Corp., of Ridgefield, N.J.

*Primary Examiner*—Howard N. Goldberg

*Assistant Examiner*—Irene Cuda

*Attorney, Agent, or Firm*—James R. Duzan; E. Harrison Gilbert, III

[57] ABSTRACT

A cushioning apparatus for a railway car includes a housing having a cylinder bore disposed therein with an end plate closing one end of the cylinder bore. A piston assembly includes a shaft extending through the end plate and a piston disposed on the shaft and slidably received within the cylinder bore. The piston is slidable between an axially innermost position furthest from the end plate and an axially outermost position closest to the end plate. A limit pin has an interference fit within a pin bore of the end plate and extends outward therefrom toward the piston for initially limiting axially outward movement of the piston short of its axially outermost position to thereby limit a length of the cushioning apparatus prior to installation of the cushioning apparatus in a railway car. To repair the cushioning apparatus, the cylinder, cylinder end plate and piston assembly are removed from the housing. The original limit pin can then be relocated, or if necessary it can be replaced with a new limit pin, to again limit the length of the cushioning apparatus prior to reinstallation of the cushioning apparatus in the railway car.

15 Claims, 4 Drawing Sheets

REPAIR OF RAILWAY CUSHIONING APPARATUS

BACKGROUND OF THE INVENTION

1.Field Of The Invention

The present invention relates generally to the repair of railway cushioning apparatus, and particularly to the repair of gas-return types of railway cushioning apparatus.

2.Description Of The Prior Art

Railway cars often use cushioning apparatus associated with the car coupling devices located on the end of the railway cars, to absorb shocks created when railway cars are connected, and also to absorb shocks created during so-called "train action events " which occur as the train is under way. These cushioning apparatus are generally referred to as end-of-car cushioning devices.

A typical end-of-car cushioning device of the type previously manufactured by the assignee of the present invention is shown in U.S. Pat. No. 3,589,527 to Seay, et al. That device is a hydraulic cushioning device which utilizes a mechanical return spring. It will be apparent upon a comparison of the drawings of the present application to the disclosure of the Seay '527 patent that the arrangement of the housing, cylinder, cylinder end plate, piston, shaft and flapper valve of the apparatus of the present invention is somewhat similar to that of the Seay '527 patent.

It is also known in the art to utilize compressed gas in a hydraulic cushioning unit so that the compressed gas provides a return force which allows mechanical springs like those of the Seay '527 patent to be eliminated. One example of such a gas return cushioning unit is shown in U.S. Pat. No. 4,026,418 to Hawthorne.

One problem which has to be dealt with when using a gas return cushioning unit is the assembly of the cushioning unit with the railway car at the customer's facility.

If the cushioning unit is charged with compressed gas prior to shipment to the customer, then the customer must deal with the placement of a fully extended cushioning unit into the sill of the railway car. As will be appreciated by those skilled in the art, the cushioning unit is constructed to closely fit within the longitudinal dimensions of the railway car sill when fully extended.

One solution is to dimension the cushioning unit so that when it is in its fully extended position it will just fit within a railway car sill of specified standard dimensions. A problem with that approach is that inaccuracies and/or tolerances allowed during the construction of the railway car sill may cause the sill to be slightly shorter than specified. Also, tolerances are present in the construction of the cushioning units themselves. This combination of inaccuracies and/or tolerances may provide occasional situations where the fully extended cushioning unit is longer than the particular railway car sill opening into which it is to be placed. In such a situation, some means must be provided for holding the cushioning unit in a partially compressed position as it is placed within the railway car sill.

As will be appreciated by those skilled in the art, due to the size and weight of these cushioning units and the difficulty of placing them in the railway car sills, it can be a difficult and dangerous operation to hold a unit partly compressed while placing it in a car sill.

Another approach to this problem is to ship the cushioning unit to the customer in an uncharged condition.

The unit is then mounted in the railway car, and subsequently compressed gas is added to the unit by the customer.

The difficulty with this approach is that it is inconvenient and undesirable for the customer to have to perform the gas charging procedure. Also, the gas charging pressure cannot be controlled by the manufacturer and this presents the possibility of improper charging which can lead to improper functioning of the cushioning unit.

SUMMARY OF THE INVENTION

The present invention provides an improved gas charged hydraulic cushioning apparatus which solves the above-mentioned problems, and particularly provides methods for assembling and for repairing such cushioning apparatus. The apparatus can be precharged with gas prior to shipping to the customer, and is initially held in a position short of a fully extended position so that it can be easily placed within the railway car sill. Subsequent to mounting of the unit within the railway car sill, it is easily extended to a further extended position by the mere application of a draft force to the cushioning unit in excess of a predetermined level.

The cushioning apparatus of the present invention includes a housing having a cylinder bore disposed therein and a cylinder end plate closing one end of the cylinder bore. A piston means includes a shaft extending through the cylinder end plate, and a piston disposed on the shaft and slidably disposed within the cylinder bore. The piston is slidable between an axially innermost position furthest from the end plate and an axially outermost position closest to the end plate.

A displaceable limit means is located internally within the housing and is operably associated with the piston means for initially limiting axially outward movement of the piston short of its axially outermost position to thereby initially limit a length of the cushioning apparatus prior to installation of the cushioning apparatus in the railway car.

The displaceable limit means includes a cylindrical limit pin received with an interference fit within a pin bore of the cylinder end plate, and extending from the pin bore toward the piston.

The axially outward force applied to the piston and thus to the limit pin by the compressed gas precharge of the cushioning apparatus is insufficient by itself to move the limit pin within the pin bore. Thus, the limit pin holds the cushioning apparatus in a partly contracted position so that it may be easily placed within the sill opening of a railway car.

After the cushioning apparatus is mounted within the railway car, the application of a draft force or a hydraulic jacking force above a predetermined level is sufficient to move the limit pin further into the pin bore thus allowing the cushioning apparatus to extend until the housing thereof abuts a draft stop of the railway car.

The cushioning unit can be repaired by removing the cylinder, cylinder end plate and piston means from the housing. The original limit pin can then be relocated to a satisfactory position for reassembly of the apparatus with a rail car. Alternatively, the original limit pin can be replaced with a new limit pin.

Numerous objects, features and advantages of the present invention will be readily apparent to those skilled in the art upon a reading of the following disclosure when taken in conjunction with the accompanying drawings.

BRIEF DESCRIPTION OF THE INVENTION

FIG. 2 is a bottom view of the cushioning apparatus of the present invention.

FIG. 3 is a side elevation sectioned view of the cushioning apparatus of FIG. 2 taken along lines 3—3 of FIG. 2.

FIG. 6 is an end elevation view of the cushioning unit taken along line 6—6 of FIG. 3.

DETAILED DESCRIPTION OF THE PREFERRED EMBODIMENTS

Figure 1:
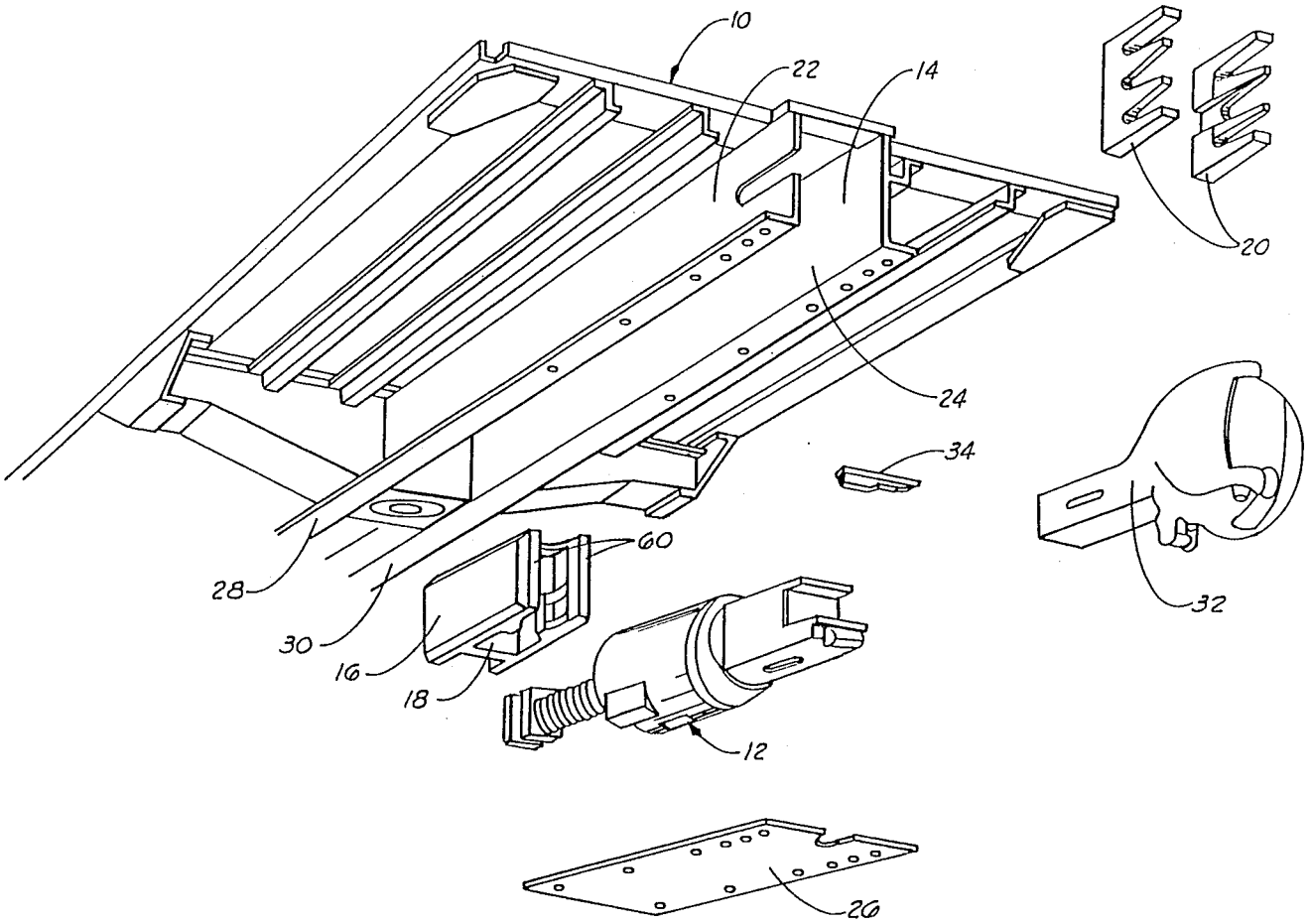
FIG. 1 is an exploded view of the bottom portion of a railway car showing the sill opening and the cushioning apparatus of the present invention.

FIG. 1 shows an isometric exploded lower view of a railway car 10, the cushioning apparatus 12 of the present invention, and associated components which are assembled therewith.

Figure 4:
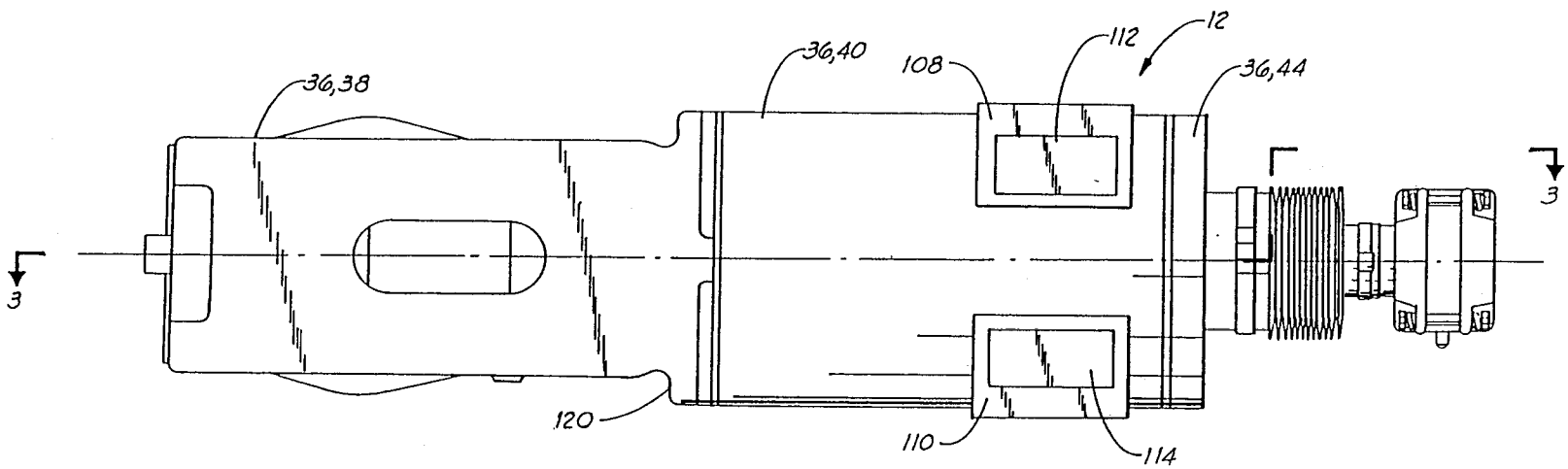
FIG. 4 is a sectioned elevation view somewhat similar to that of FIG. 3 showing the cushioning apparatus as initially held by the limit pins in a partially contracted position, and showing the partially contracted cushioning apparatus in place within a railway car sill.
Figure 5:
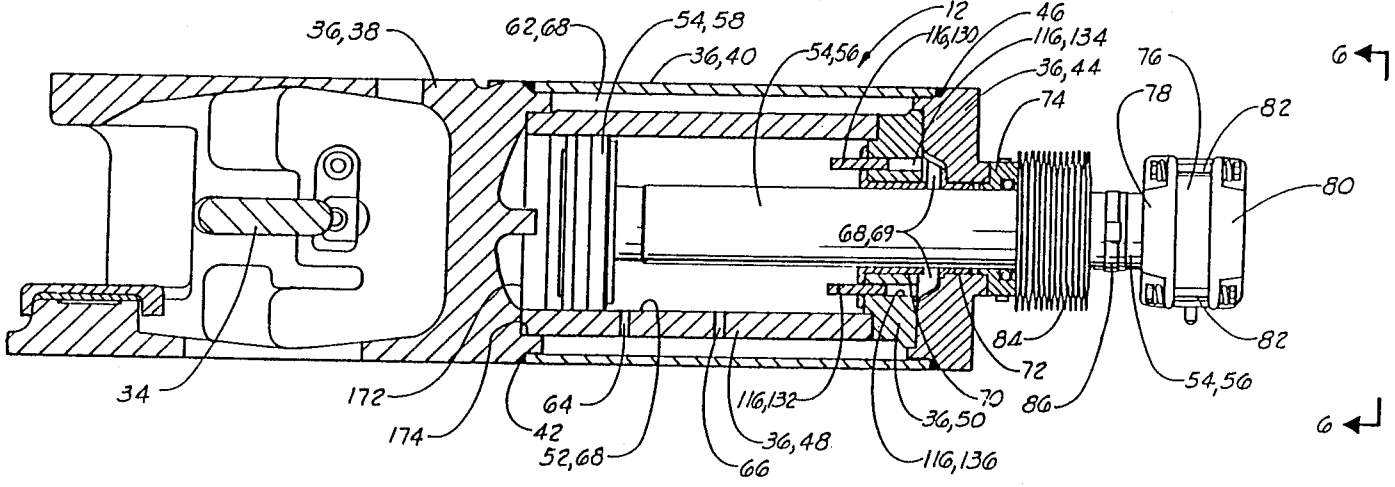
FIG. 5 is a view somewhat similar to FIG. 4, showing the position of the cushioning apparatus after a draft force has been applied thereto sufficient to move the limit pins further into the pin bores and to allow the cushioning unit to further extend until the housing thereof abuts the draft stop of the railway car.
Figure 4:
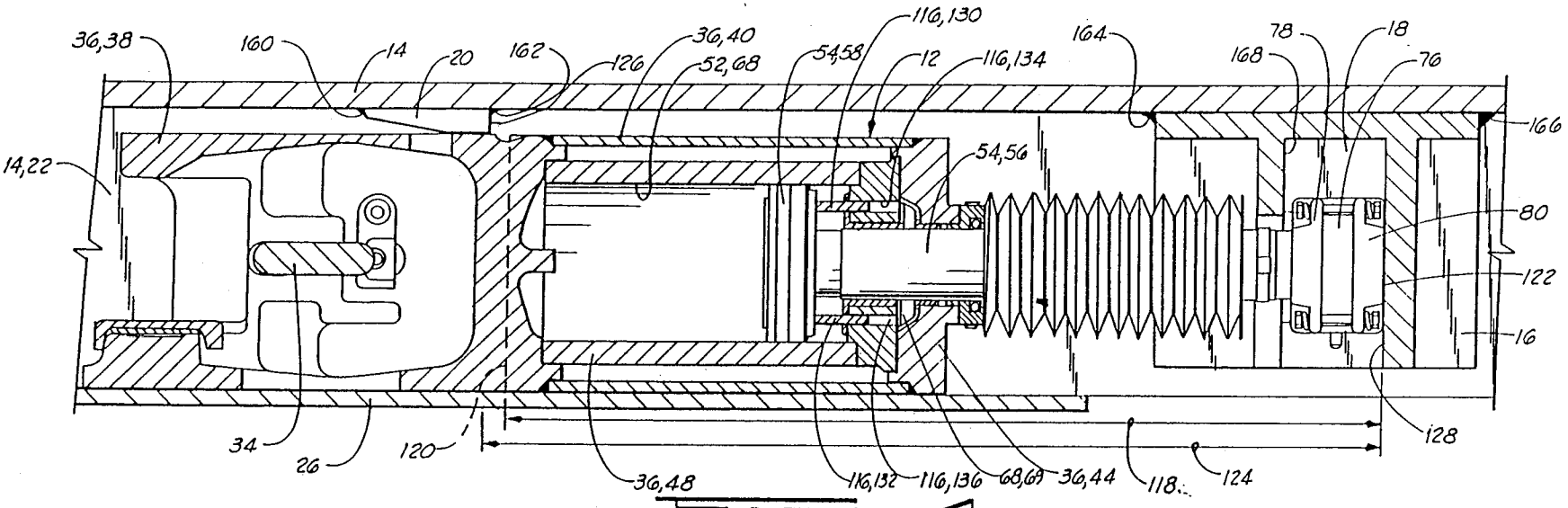
Figure 5:
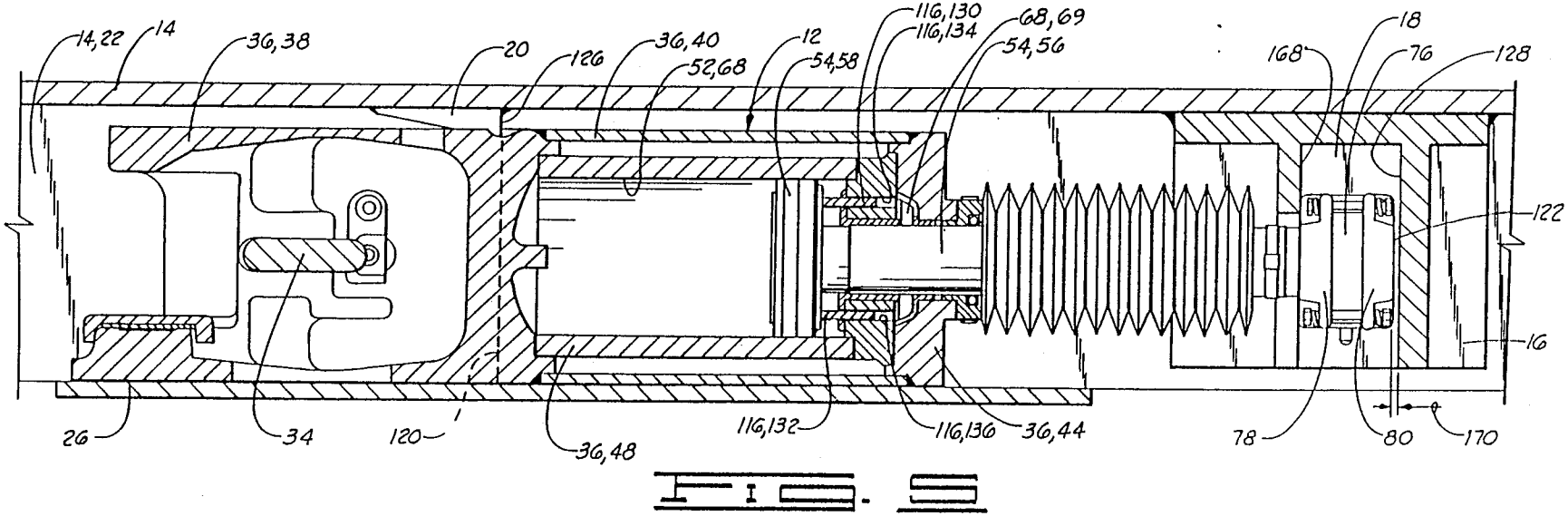

The railway car 10 includes a car sill 14 which is a box-like portion of the framework of the car 10. The car 10 also includes a unitized precast shaft end housing 16 which is secured within the sill 14 by conventional welding techniques as can be seen in FIGS. 4 and 5. The shaft end housing 16 has a shaft end opening 18 defined therein as is further described below.

The railway car 10 further includes a pair of draft stops 20 which are located within the sill 14 and welded to the side walls 22 and 24 thereof as seen in FIGS. 4 and 5.

The car 10 further includes a sill base plate 26 which is located under the cushioning apparatus 12 to hold the same within the sill 14. The sill base plate 26 is attached to horizontal flanges 28 and 30 of sill 14 by bolting.

A draw bar 32, which may also be referred to as a coupler bar 32, is connected to the cushioning apparatus 12 by a key 34.

Referring now to FIGS. 2 and 3, the cushioning apparatus 12 includes a housing generally indicated by the numeral 36.

The housing 36 includes a housing body 38 joined to a cylindrical housing shell 40 at weld 42.

Housing 36 further includes a housing end plate 44 connected to housing shell 40 at weld 46.

Located within the housing shell 40 and held tightly between the housing body 38 and housing end plate 44 are a cylinder 48 and cylinder end plate 50 which may also be considered to be portions of the overall housing assembly 36.

The cylinder 48 has a cylindrical cylinder bore 52 disposed therein. The cylinder end plate 50 closes one end of the cylinder bore 52.

A piston means 54 includes a shaft 56 extending through cylinder end plate 50 and housing end plate 44, and includes a piston 58 disposed on the end of shaft 56 and slidably received within the cylinder bore 52.

The piston 58 is slidable between an axially innermost position furthest from the cylinder end plate 50 as illustrated in FIG. 3, and an axially outermost position (not shown) abutting flapper valve ring 90.

The fully compressed position of the cushioning apparatus 12 as illustrated in FIG. 3 is defined by abutment of the housing end plate 44 with forwardmost portions 60 of shaft end housing 16 (see FIG. 1) which may be referred to as buff stops 60.

The terms buff and draft as used herein are used in their conventional sense in the railway industry. The term buff refers to forces tending to move one rail car towards another and thus to compress the cushioning appparatus 12, and the term draft refers to the forces tending to move rail cars apart from each other and thus to extend the cushioning apparatus 12.

An annular space 62 is defined between the cylindrical housing shell 40 and the cylinder 48. The annular space 62 and the cylindrical space within cylinder bore 52 are communicated by a plurality of radial ports such as those schematically illustrated at 64 and 66 in FIG. 3. The ports such as 64 and 66, which may sometimes be utilized in connection with valves (not shown) connected therewith, control the hydraulic damping characteristics of the cushioning apparatus 12 in a manner like that described in U.S. Pat. No. 3,589,527 to Seay, with regard to the ports and valves shown in FIG. 3 thereof.

The annular space 62 and the cylindrical space defined within cylinder bore 52 may jointly be referred to as a fluid chamber 68. Fluid chamber 68 is also communicated with and includes an annular space 69 between cylinder end plate 50 and housing end plate 44. Most of the fluid chamber 68 including that portion within the cylinder bore 52 is filled with a hydraulic oil, and the remainder of the fluid chamber 68 is filled with a pressurized gas. The pressurized gas causes a restoring force to be applied to the piston 58 urging it to move to the right as seen in FIG. 3 and thus to extend the cushioning apparatus 12. This restoring force is determined by the pressure of the compressed gas as applied across the cross-sectional area of the shaft 56.

The shaft 56 is received through a cylinder end plate bushing 70 and a housing end plate bushing 72. A shaft seal assembly 74 is attached to the housing end plate 44 and seals against the shaft 56.

An elliptical radius ball 76 is threadedly connected to the end of shaft 56 and has inner and outer radius plates 78 and 80, respectively, sandwiched thereabout by a plurality of radius plate bolts 82.

A bellows 84 is connected at one end to the shaft seal assembly 74 and at the other end to the outer portion of shaft 56 by band 86. As is apparent in FIGS. 4 and 5, the bellows 84 expands in an accordion-like manner to protect the cylindrical outer surface of shaft 56 to the extent that shaft 56 protrudes from the housing 36 during reciprocating motion of the piston means 54 within the housing 36.

Figure 8:
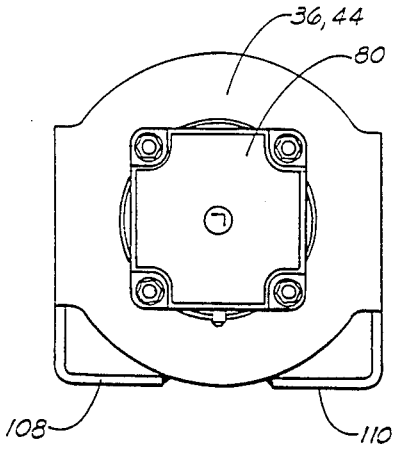
FIG. 8 is an enlarged sectioned elevation view of the cylinder end plate and associated apparatus oriented the same as shown in FIG. 3.

As is best seen in FIG. 8, a flapper valve assembly 88 is associated with the housing end plate 50. Flapper valve assembly 88 includes a flapper ring 90 having a central opening 92 through which the shaft 56 passes.

A plurality of guide studs 94 are attached to flapper ring 90 and extend through guide bores 96 disposed through the cylinder end plate 50.

The guide studs 94 have enlarged ends 98 received in counterbores 100 of guide bores 96. Coil compression springs 102 are disposed between enlarged ends 94 and shoulders 104 defined between bores 96 and counterbores 100 so as to urge the flapper ring 90 against the cylinder end plate 50 as shown in FIG. 8.

Upon the application of a relatively large buff force to the cushioning apparatus 12, the flapper ring 88 moves to the left away from the cylinder end plate 50 to uncover a plurality of flapper valve ports 106 (see FIG. 7) disposed through the cylinder end plate 50 and to allow hydraulic fluid to flow from annular space 69 into the cylinder bore 52 between the piston 58 and the cylinder end plate 50.

Figure 7:
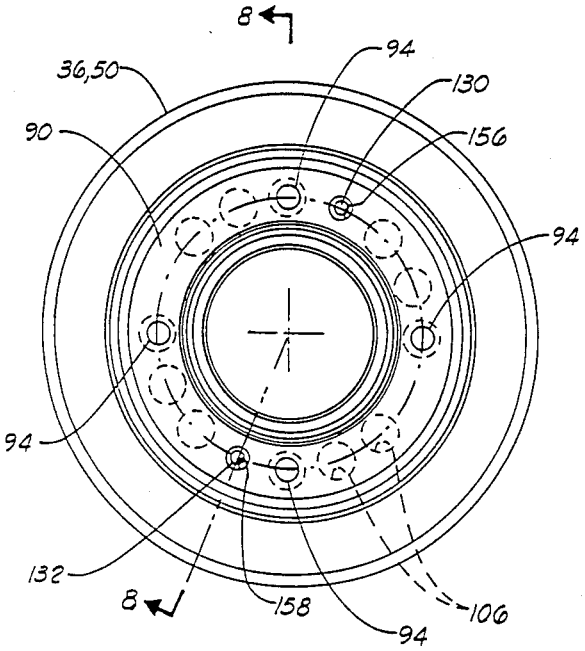
FIG. 7 is an elevation view of the cylinder end plate and associated apparatus as viewed along lines 7—7 of FIG. 8.
Figure 8:
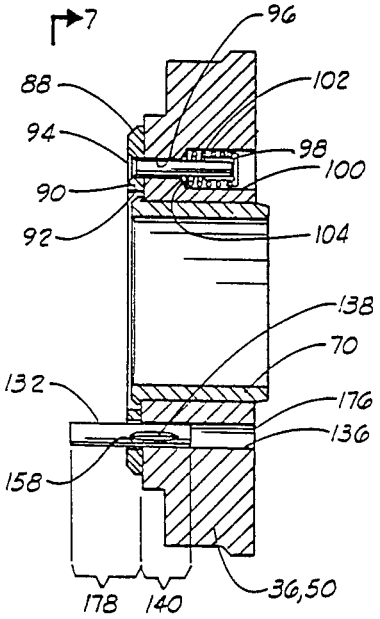

As is apparent in FIG. 7, the flapper ring 90 is supported by four such guide studs 94.

As best seen in FIGS. 2 and 6, a pair of angle-shaped support members 108 and 110 having wear surfaces 112 and 114, respectively, disposed thereon, are attached to the cylindrical housing shell 40 by welding and extend downward therefrom to support the cushioning apparatus 12 upon the sill base plate 26.

In order to prevent the shaft 56 of piston means 54 from fully extending from the housing 36 during installation of the apparatus 12 within the railway car sill 14, the apparatus 12 is provided with a displaceable limit means 116. The limit means 116 is located internally within the housing 36 and is operably associated with the piston means 54 for initially limiting outward movement of the piston 58 to an initial extended position as shown in FIG. 4, short of its axially outermost position to thereby initially limit a length 118 of apparatus 12 prior to installation of the apparatus 12 in the railway car 10.

The initial extended length 118 of significance is the length between a draft stop abutment surface 120 of housing 36 and an outer end surface 122 of outer radius plate 80 when the piston 58 initially engages the limit means 116 as illustrated in FIG. 4.

As best seen in FIG. 4, the car sill 14 has a longitudinal opening dimension 124 defined between an abutment surface 126 of draft stops 20 and a surface 128 of shaft end opening 18 of shaft end housing 16.

Thus, the limit means 116 initially limits the length 118 of apparatus 12 to a value less than the length 124 of the longitudinal opening of car sill 14, so that the apparatus 12 may be easily placed within the car sill 14 as illustrated in FIG. 4.

The limit means 116 includes a pair of limit pins 130 and 132 which are received with an interference fit within pin bores 134 and 136, respectively, disposed through cylinder end plate 50.

The construction of the limit pins 130 and 132, and their assembly with the pin bores 134 and 136, are best shown in FIGS. 7–10.

As seen in FIG. 7, the pins 130 and 132 are on diametrically opposite sides of the shaft 56.

Figure 9:
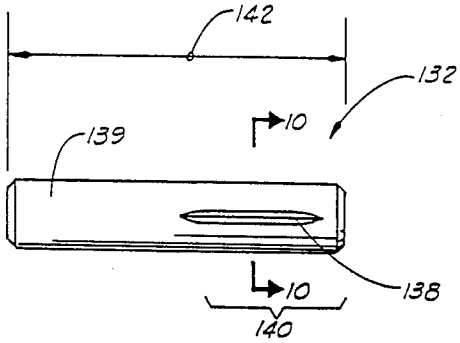
FIG. 9 is a side elevation view of the limit pin.
Figure 10:
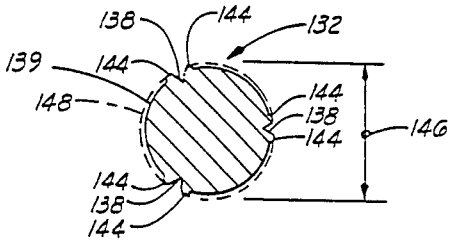
FIG. 10 is a sectioned view of the limit pin of FIG. 9 taken along line 10—10 of FIG. 9.

As best seen in FIGS. 9 and 10, the limit pin 132 has three axially extending grooves 138 disposed in cylindrical outer surface 139 thereof along a majority of a portion 140 of a length 142 thereof. The portion 140 is received in the pin bore 136 when the limit pin 132 is in its initial position within the pin bore 136 as illustrated in FIGS. 3, 4, and 8.

The grooves 138 are rolled or punched into the pin 132 so as to displace material therefrom to form radially outward extending ridges 144 which protrude outward from the cylindrical outer surface 139 to provide an enlarged effective outer diameter 146 (see FIG. 10) of limit pin 132 along the length of grooves 138. The effective outer diameter 146 is the diameter of an imaginary circle 148 defined by the radially outer extremities of ridges 144.

The pin 132 is itself a part of the prior art and is designated as a type H low carbon steel zinc plated ½-inch diameter by 2½-inch long grooved pin available from Driv-Lok, Inc., of Sycamore, Ill. Similar pins are also available from other manufacturers.

The various dimensions of limit pin 132 and pin bore 136 are chosen to provide an interference fit therebetween which provides a predictable frictional force opposing movement of the pin 132 in the pin bore 136.

The portion 140 of limit pin 132 which is initially inserted in pin bore 136 to define the initial position of limit pin 132 therein has a length such that a portion of the groove 138 still extends out from bore 136 as is seen in FIG. 8.

The force required to drive the pin 132 into the bore 136 increases in a generally linear fashion until the grooves 138 are completely received in bore 136. Then the required load slowly declines as the pin 132 is driven further into the pin bore 136. Thus by leaving a small portion of the grooves 138 initially out of the pin bore 136, it is assured that the maximum possible force will be required to drive the pin 136 substantially further into pin bore 136.

The limit pins 130 and 132 can be generally described as an abutment means 130,132, carried by one of the piston 58 and the cylinder end plate 50 for abutting the other of the piston 58 and the cylinder end plate 50 upon movement of the piston 58 toward the cylinder end plate 50.

The interference fit between the ridges 144 of pins 130 and 132 and the pin bores 134 and 136, respectively, can be generally described as a release means operatively associated with the limit pins 130 and 132 for permitting the limit pins 130 and 132 to move axially relative to the cylinder end plate 50 upon application of an axially outward force to the shaft 56 in excess of a predetermined value.

As is apparent in FIGS. 3, 4 and 5, the cylinder end plate 50 is located relative to the housing end plate 44 such that the limit pins 130 and 132 are prevented from being displaced axially outward entirely out of the pin bores 134 and 136. This is an important safety feature, because if through some unexpected circumstance, a sufficient force were applied to the pins 130 and 132 to drive them completely through the pin bores 134 and 136, that would then provide an open fluid path to the cylinder bore 52 thus causing the apparatus 12 to malfunction.

As previously mentioned, the hydraulic fluid within fluid chamber 68 is charged with compressed gas to provide a restoring force acting on the piston 54 causing it to move toward an extended position. This return force or restoring force is considerably less than the force required to displace the limit pins 130 and 132 from their initial position.

As is apparent in FIGS. 7 and 8, the flapper valve ring 90 has openings 156 and 158 through which the limit pins 130 and 132, respectively, freely pass so as not to interfere with the operation of flapper valve 88.

INSTALLATION OF THE CUSHIONING APPARATUS

As previously described, when the limit pins 130 and 132 are in their initial positions as illustrated in FIGS. 3, 4 and 8, they limit axially outward movement of the piston 58 short of its fully extended position thus initially limiting the length 118 of apparatus 12 between its draft stop abutment surface 120 and the outer end surface 122 of outer radius plate 80 to a value less than the longitudinal opening 124 between abutment surface 126 of draft stops 20 and a surface 128 of shaft end opening 18 of shaft end housing 16.

It is the restoring force from the compressed gas that will automatically urge the piston 58 toward its fully extended position. This compressed gas is charged into the apparatus 12 prior to the placement of the cushioning apparatus 12 within the sill 14. Preferably, the compressed gas is added by the manufacture prior to shipping of the apparatus 12 to the customer for installation.

When the apparatus 12 is to be installed in the car sill 14, the draft stops 20 and the shaft end housing 16 will have already been welded in place within the sill 14 as indicated by welds 160, 162, 164 and 166 seen in FIGS. 4 and 5.

The cushioning apparatus 12 will be laid on top of sill base plate 26 which typically will be supported by a forklift (not shown). The forklift will then lift the sill base plate 26 and the cushioning apparatus 12 into place within the sill 14 with the radius ball assembly 76,78,80 received in shaft end opening 18 of shaft end housing 16 and with the draft stop abutment surface 120 located axially inward of abutment surface 126 of draft stops 20 as seen in FIG. 4. The sill base plate 26 can then be bolted to the flanges 28 and 30 of sill 14, and the coupling device 32 can be connected to the housing body 38 by key 34.

After the cushioning apparatus 12 is installed as shown in FIG. 4, a draft load in excess of the frictional holding force of limit pins 130 and 132 is applied to the cushioning apparatus 12 to displace the limit pins 130 and 132 from their initial positions further into the pin bores 134 and 136 as seen in FIG. 5 so that the draft stop engaging surface 120 of housing 36 engages the abutment surfaces 126 of draft stops 20.

As seen in FIG. 5, when the draft load is applied to the cushioning apparatus 12, the apparatus 12 will slide to the left a slight distance relative to the sill 14 until the inner radius plate 78 abuts a surface 168 of shaft end opening 18 of shaft housing 16. Then the piston 58 will drive the limit pins 130 and 132 further into pin bores 134 and 136 until the draft stop abutment surface 120 of housing 36 engages the draft stops 20.

As is apparent in FIG. 5, with the cushioning apparatus 12 in its further extended position, there is a clearance 170 between outer end surface 122 of outer radius plate 80 and surface 128 of shaft end opening 18 of shaft end housing 16.

Thus, the clearance 170 will allow the cushioning apparatus 12 to subsequently be removed from and then replaced in the sill 14 without any problem due to an over-extension of the shaft 56.

As is apparent in FIGS. 4 and 5, the difference between the lengths 118 and 124, the clearance 170, and the related distance by which the limit pins 130 and 132 are driven into the pin bores 134 and 136 when the cushioning apparatus 12 is extended from the position of FIG. 4 to the position of FIG. 5 are all relatively small.

Typically, the longitudinal opening length 124 of sill 14 will exceed the initial extended length 118 of cushioning apparatus 12. The clearance 170 exits between the radius ball assembly 76,78,80 and either surface 128 or 168 of shaft end opening 18. When the cushioning apparatus 12 moves from its initial position as illustrated in FIG. 4 to a fully extended position as illustrated in FIG. 5, the limit pins 130 and 132 are driven deeper into the pin bores 134 and 136 from their initial position.

A fully extended position of apparatus 12 with piston 58 abutted with flapper valve ring 88 is never achieved due to the continued action of the limit pins 130 and 132. If it were fully extended, however, the length from draft stop abutment surface 120 to the end 122 of outer radius plate 80 would exceed the length 124 of the sill opening. The flapper valve ring has a thickness so that the apparatus 12 would have a fully extended length between draft stop abutment surface 120 and end surface 122 longer than the sill opening 124.

REPAIRING THE CUSHIONING APPARATUS

Cushioning apparatus of the general type of the apparatus 12 have a long service life. Then the apparatus is typically remanufactured to place it in a like-new condition. Also, there are of course occasional unexpected failures at an earlier date that require the unit to be repaired.

To repair the cushioning unit 12, and return the limit means 116 to an operable condition so that the repaired cushioning unit can be replaced within a railway car sill in the manner generally described above, special attention must be given to the limit means 116.

The repair of the cushioning apparatus 12 first involves the general disassembly thereof.

This is accomplished by first machining out, torch cutting, or the like of the weld connection 46 between housing shell 40 and housing end plate 44.

Then, the apparatus 12 is suspended vertically from the housing body 38, and the housing end plate 44, cylinder end plate 50, cylinder 48, and piston means 54 are removed from the housing body 38 and cylindrical housing shell 40 by hammering and/or heating the housing 36 adjacent an end 172 of cylinder 48 to cause the cylinder 48 and the other connected components to drop out of engagement with the housing body 38 and cylindrical housing shell 40.

The end 172 of cylinder 48 was initially assembled with the housing body 38 by press fitting the cylinder 48 within a bore 174 of housing body 38. Hammering and/or heating the housing body 38 and cylindrical housing shell 40 adjacent the end 172 of cylinder 48 eventually causes the cylinder 48 to drop out of engagement with the bore 174 of housing body 38.

Once the cylinder 48, cylinder end plate 50, housing end plate 44, and piston means 54 are removed from the housing body 38 and cylindrical housing shell 40, those components can be disassembled.

The limit pins 130 and 132 can in some instances be relocated and reused, and in other instances must be replaced with new limit pins.

It will be appreciated that the limit pins 130 and 132 generally will have been driven inward into the pin bores 134 and 136 to a position like that shown in FIG. 5. It is desired to return the limit pins 130 and 132 to a position like that shown in FIG. 4 wherein they extend further out from the pin bores 134 and 136 than would normally be the case when the apparatus 12 is disassembled.

Preferably, a device (not shown) is inserted into an open end 176 (see FIG. 8) of the pin bores 134 and 136 to drive the pins 130 and 132 back to an initial position like that shown in FIG. 8. This driving instrument is provided with a means for measuring the force required to drive the pin back to its initial position and for thereby determining if the pin is suitable for reuse.

Preferably, the pins are driven back or relocated to approximately their original position as shown in FIGS. 3, 4 and 8. It will be appreciated, however, that it is undesirable to repeatedly drive the pins 130 and 132 back and forth to achieve exact positioning. Accordingly, it is satisfactory if the pins 130 and 132 can be relocated to a position approximating their original position.

If the measured force required to drive the pins 130 and 132 outward to approximately their initial positions is so low as to indicate that the pins can no longer provide a holding force adequate to reliably limit outward movement of the piston 54, then the original limit pins 130 and 132 must be removed completely from the pin bores 134 and 136 and discarded. The original pins are then replaced with new limit pins which are driven into the pin bores 134 and 136 to an initial position like that shown in FIG. 8.

Then after other necessary repairs have been made, the cushioning apparatus 12 can be reassembled to a configuration like that shown in FIG. 3, and subsequently compressed gas can be charged to the repaired cushioning apparatus 12 to move it to an extended position like that shown in FIG. 4 wherein the limit pins 130 and 132 (which may be either relocated original pins or new replacement pins) prevent the shaft 56 from moving to a fully extended position, thus allowing the repaired cushioning apparatus 12 to be easily replaced within the sill 14 as illustrated in FIG. 4.

Thus, it is seen that the apparatus of the present invention readily achieves the ends and advantages mentioned as well as those inherent therein. While certain preferred embodiments of the invention have been illustrated for the purposes of the present disclosure, numerous changes in the arrangement and construction of parts may be made by those skilled in the art, which changes are encompassed within the scope and spirit of the present invention as defined by the appended claims.

What is claimed is:

1. A method of repairing a cushioning apparatus having:

a housing including a cylinder disposed therein, said cylinder having a cylinder bore defined therein, and said housing further including a cylinder end plate closing one end of said cylinder bore;

a piston means including a piston slidably received in said cylinder bore and a shaft extending from said piston through said cylinder end plate; and an original limit pin received in a pin bore of said cylinder end plate with an interference fit therebetween, said pin extending a first distance out of said pin bore toward said piston;

said method comprising the steps of:

(a) removing said cylinder, said cylinder end plate, and said piston means from said housing; and (b) providing a relocated limit pin received in said pin bore and extending a second distance out of said pin bore toward said piston, said second distance being different from said first distance, and said second distance being sufficient to initially limit axially outward movement of said piston means within said cylinder upon reassembly of said cushioning apparatus to a position of said piston means short of a fully extended position thereof.

2. The method of claim 1, wherein:

step (b) is further characterized in that said relocated limit pin is said original limit pin.

3. The method of claim 2, wherein:

step (b) is further characterized as displacing said original limit pin within said pin bore to provide said relocated limit pin without removing said original limit pin from said pin bore.

4. The method of claim 3, further including the step of:

during the step of displacing said original limit pin, measuring a force required to displace said original pin to determine that said force still exceeds a predetermined minimum value.

5. The method of claim 2, wherein:

step (b) is further characterized as removing said original limit pin from said pin bore and then replacing said original limit pin into said pin bore to provide said relocated limit pin.

6. The method of claim 1, wherein:

step (b) is further characterized in that said relocated limit pin is another limit pin which replaces said original limit pin.

7. The method of claim 1, further comprising the step of:

prior to placing said cushioning apparatus in a railway car, charging said cushioning apparatus with compressed gas so that a pressure of said gas is communicated with said piston means in said cylinder bore to urge said piston means toward its fully extended position, said pressure of said gas being low enough that a force exerted thereby on said piston means is insufficient to move said relocated limit pin within said pin bore.

8. A method of repairing a cushioning apparatus having:

a housing including a cylinder disposed therein, said cylinder having a cylinder bore defined therein, and said housing further including a cylinder end plate closing one end of said cylinder bore;

a piston means including a piston slidably received in said cylinder bore and a shaft extending from said piston through said cylinder end plate; and an original limit pin received in a pin bore of said cylinder end plate with an interference fit therebetween, said pin extending from said pin bore toward said piston;

said method comprising the steps of:

(a) removing said cylinder, said cylinder end plate, and said piston means from said housing;

(b) removing said original limit pin from said pin bore;

(c) placing a replacement limit pin in said pin bore with an interference fit therebetween and with said replacement limit pin extending from said pin bore for engagement with said piston; and (d) reassembling said cylinder, said cylinder end plate, and said piston means with said housing, with said replacement limit pin holding said piston means short of a fully extended position thereof.

9. The method of claim 8, wherein:

step (c) is further characterized in that said replacement limit pin extends from said pin bore a greater distance than did said original limit pin when said cylinder end plate was removed from said housing in step (a).

10. The method of claim 8, wherein:

step (c) is further characterized in that said replacement limit pin is said original limit pin which is returned to said pin bore.

11. The method of claim 8, wherein:

step (c) is further characterized in that said replacement limit pin is another limit pin which replaces said original limit pin.

12. The method of claim 8, further comprising the step of:

prior to placing said cushioning apparatus in a railway car, charging said cushioning apparatus with compressed gas so that a pressure of said gas is communicated with said piston means in said cylinder bore to urge said piston means toward its fully extended position, said pressure of said gas being low enough that a force exerted thereby on said piston means is insufficient to move said replacement limit pin within said pin bore.

13. A method of assembling a cudshioning apparatus to be received in a sill oipening of a railway car, said method comprising the steps of:

(a) providing a cushioning apparatus having a housing with a cylinder bore therein, and having a piston means with a piston slidably received in said cylinder bore and a shaft attached to said piston and extending from said housing, said piston means being slidably between a contracted position and a fully extended position, said cushioning apparatus having a fully extended length between a draft stop engaging surface of said housing and an outer end of said shaft when said piston means is in its said fully extended position, said fully extended length being greater than a length of said sill opening;

(b) initially limiting axially outward movement of said piston means short of its fully extended position, and thereby limiting an initial extended length of said cushioning apparatus between said draft stop engaging surface and said outer end of said shaft to less than said length of said sill opening, by assembling a limit means with said housing and piston means, said limit means being located internally within said housing; and wherein said step is further characterized as placing a limit pin in an initial position within a pin bore of said housing, so that a first portion of said pin has an interference fit with said pin bore and a second portion of said pin extends out of said pin bore toward said piston so that when said piston is abutted with said pin in its said initial position, said cushioning apparatus has said initial extended length less than said length of said sill opening.

14. The method of claim 13, further comprising the step of:

(c) charging said cushioning apparatus with compressed gas so that a pressure of said gas is communicated with said piston means in said cylinder bore to urge said piston means toward its fully extended position, said pressure of said gas being low enough that a force exerted thereby on said piston means is insufficient to move said limit pin from its initial position within said pin bore.

15. The method of claim 14, being further characterized as a method of assembling a cushioning apparatus and installing the same in the sill opening of a railway car, said method further comprising the steps of:

(d) after step (c), placing said cushioning apparatus in said sill opening while said limit pin is limiting extension of said piston means so that said cushioning apparatus has said initial extended length less than said length of said sill opening; and (e) after step (d), applying a draft load to said cushioning apparatus sufficient to displace said limit pin from its initial position further into said pin bore so that said draft stop engaging surface of said housing engages a draft stop of said railway car.

* * * * *